US005185232A

United States Patent [19]

Sasaoka

[11] Patent Number: 5,185,232

[45] Date of Patent: Feb. 9, 1993

[54] METHOD OF IMAGE FORMATION

[75] Inventor: Senzo Sasaoka, Kanagawa, Japan

[73] Assignee: Fuji Photo Film Co., Ltd., Kanagawa, Japan

[21] Appl. No.: 614,422

[22] Filed: Nov. 16, 1990

[30] Foreign Application Priority Data

Nov. 24, 1989 [JP] Japan ..... 1-306033

[51] Int. Cl.[5] ..... G03C 1/06

[52] U.S. Cl. ..... 430/264; 430/509; 430/267; 430/949; 430/615; 430/502

[58] Field of Search ..... 430/264, 509, 267, 949, 430/615, 502

[56] References Cited

U.S. PATENT DOCUMENTS

| | | | |
|---|---|---|---|
| 3,923,515 | 12/1975 | van Stappen | 430/509 |
| 4,447,522 | 5/1984 | Hirano et al. | 430/264 |
| 4,746,593 | 5/1988 | Kitchin et al. | 430/264 |
| 4,761,362 | 8/1988 | Sasaoka et al. | 430/264 |
| 4,786,587 | 11/1988 | Kuwabara | 430/264 |
| 4,818,659 | 4/1989 | Takahashi et al. | 430/264 |
| 4,920,034 | 4/1990 | Sasaoka et al. | 430/264 |
| 4,956,263 | 9/1990 | Ishigaki et al. | 430/264 |
| 4,957,849 | 9/1990 | Inoue et al. | 430/264 |

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A method of image formation comprising imagewise exposing a silver halide photographic photosensitive material comprising a support having thereon at least two silver halide emulsion layers and which contains a hydrazine compound in the emulsion layers or in another hydrophilic colloid layer wherein the photographic speed of the emulsion layer on the side furthest from the support of the above mentioned silver halide layers is higher by 0.1 to 0.4 logE than the photographic speed of the emulsion layer which is closest to the support, through the support, and developing the imagewise exposed photosensitive material, whereby a high contrast negative image of a gamma at least 8 is obtained.

8 Claims, No Drawings

METHOD OF IMAGE FORMATION

FIELD OF THE INVENTION

The present invention concerns silver halide photographic photosensitive materials (especially of the negative type) which are used in the field of photo-mechanic process and with which an ultrahigh contrast image can be formed rapidly using a highly stable processing bath.

BACKGROUND OF THE INVENTION

It is known that photographic images which have a very high contrast can be formed using certain types of silver halides, and these methods of forming photographic images are used in the field of photomechanic process.

Conventionally, special developers known as lith developers have been used to achieve this objective. Lith developers contain only hydroquinone as the developing agent and sulfite which is employed as a preservative is used in the form of an adduct with formaldehyde and the free sulfite ion concentration is very low (generally not more than 0.1 mol/liter) so that infectious development characteristics are not impeded. Consequently, lith developers are very liable to be aerially oxidized and suffer from the serious disadvantage in that they cannot be stored for periods of more than 3 days.

Methods in which hydrazine derivatives are used as disclosed, for example, in U.S. Pat. Nos. 4,224,401, 4,168,977, 4,166,742, 4,311,781, 4,272,606, 4,211,857 and 4,243,739 provide a means of obtaining high contrast photographic characteristics using a stable developer. With these methods, photographic characteristics of high photographic speed with ultrahigh contrast are obtained, moreover, since it is possible to add high concentrations of sulfite to the developer, the stability of the developer with respect to aerial oxidation is much greater than that of a lith developer.

These ultrahigh contrast systems in which hydrazine derivatives are used provide considerable economies to be made in the coated silver weight at high photographic speeds when compared with lith developer systems. Further, they also enable rapid processing to be achieved. However, they have a disadvantage in that it is difficult to achieve $D_{max}$ on exposure from the back side (the opposite side of the support to that on which the emulsion layer is located) of the photographic material.

A method of use is known in which photographs are taken from the back through the-support (the so-called lateral reversal method) with sensitive materials for camera use. When carrying out lateral reversal, the latent image is distributed with a bias toward the side closest to the support in the emulsion layer. On the other hand, the developer permeates from the surface on the emulsion layer side. Thus, development takes place from the surface and development is retarded in the part closest to the support. Consequently, the characteristic curve with lateral reversal is such that gamma for the intermediate tone shoulder portion is reduced and it is inevitably difficult to achieve $D_{max}$. $D_{max}$ can be restored by increasing the silver coated weight but the effect of economizing considerably on the amount of silver, which is an advantage of the hydrazine high contrast system, is inevitably lost.

Furthermore, the amount of hydrazine derivative which is a nucleating agent added is sometimes increased to increase $D_{max}$, and sometimes a development accelerator is used for this purpose. As a result, $D_{max}$ is increased when infectious development is strongly promoted, but black pepper (black spotting) tends to occur and there is sometimes a deterioration in screen dot reproduction characteristics.

These problems arise as a result of the fact that with lateral reversal the latent image is formed on the side closest to the support and they do not occur when the exposure is made from the emulsion surface side (with a so-called surface exposure).

Methods in which hydrazine derivatives are used and in which two or more types of emulsion are used are disclosed, for example, in JP-A-61-223734 and JP-A-63-46437 (the term "JP-A" as used herein refers to a "published unexamined Japanese patent application"). However, in both cases use is made of a mixture of a coarse grain emulsion and a fine grain emulsion and this is different from the emulsion lamination of the present invention. Furthermore, these methods involve surface exposure and there is no disclosure of reverse exposure of the type used in the present invention.

JP-A-62-90646 and JP-A-62-8140 (both of which involve a lamination of a coarse grain emulsion layer and a fine grain emulsion layer), JP-A-63-15237 (in which a quinone scavenger is present in the intermediate layer with laminated emulsion layers), and JP-A-62-150343 (in which a high contrast emulsion layer and a low contrast emulsion layer are laminated) all involve surface exposure. There is no disclosure of a reverse exposure of the type used in the present invention which are disclosed in these published Japanese applications.

SUMMARY OF THE INVENTION

An object of the present invention is to provide a method of image formation which has a high photographic speed, a high $D_{max}$, and which is good from the standpoint of black pepper and dot reproduction in applications where lateral reversal is employed with a sensitive material for photomechanic process. Moreover, it is intended to provide a method of image formation with ultrahigh contrast of $\gamma \geqq 8$ using a stable developer by including a hydrazine derivative therein.

The above mentioned objects are achieved by a method of image formation comprising imagewise exposing through the support a silver halide photographic photosensitive material comprising a support, having thereon at least two silver halide emulsion layers and which contains a hydrazine compound in the emulsion layers or in another hydrophilic colloid layer wherein the photographic speed of the emulsion layer which is furthest from the support (the upper layer) of the silver halide layers is higher by 0.1 to 0.4 logE than the photographic speed of the emulsion layer which is closest to the support (the lower layer) whereby a high contrast negative image of gamma at least 8 is formed.

DETAILED DESCRIPTION OF THE INVENTION

It has been found that with the present invention it is possible to obtain an improvement of both $D_{max}$ and black pepper and an improvement in dot reproduction characteristics with lateral reversal.

The difference in photographic speed between the upper and lower emulsion layers in terms of $\Delta$logE is from 0.1 to 0.4. If the difference is less than 0.1 there is no effective increase in $D_{max}$. The effect of increasing $D_{max}$ is reduced and black pepper becomes more pronounced when the difference is greater than 0.4. Furthermore, the coated silver weight ratio of the upper/-lower emulsion layers is preferably from 1/5 to 5/1, and most preferably within the range from ⅓ to 3/1.

Varying the average grain size of the silver halide grains and varying the degree of chemical sensitization, for example, can be used as methods of achieving the difference in photographic speeds of the emulsions. Also, varying the type and amount of sensitizing dye added, the amount of hydrazine compound (compound represented by formula (I)) present and the amount of accelerator (compounds represented by formulae (II) and (III)) present, for example, can be used to produce these emulsions.

Furthermore, methods for measuring the photographic speeds of the upper and lower emulsion layers include, for example, a method in which samples coated for testing purposes with each emulsion layer are prepared and the speeds are evaluated sensitometrically. Furthermore, methods in which the backing layer is removed and the difference in speed is determined by sensitometry when the sample is exposed from the support side (reverse exposure) and when the sample is exposed from the emulsion layer side (surface exposure) can be used to measure the speed of the upper and lower layers of a sample in which emulsion layers have been formed as laminated layers. Whether or not the upper layer or the lower layer has been developed can be investigated by photographing a cross section of a processed sample, and the speeds of the upper and lower layers can be evaluated by measuring the speed of the upper layer with a surface exposure and the speed of the lower layer with a reverse exposure.

Suitable hydrazine derivatives which can be used in the silver halide photographic photosensitive material of the present invention are preferably compounds represented by the formula (I) indicated below:

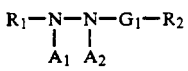

(I)

wherein $R_1$ represents an aliphatic group or an aromatic group; $R_2$ represents a hydrogen atom, an alkyl group, an aryl group, an alkoxy group, an aryloxy group, an amino group, a hydrazino group, a carbamoyl group or an oxycarbonyl group; $G_1$ represents a carbamoyl group, a sulfonyl group, a sulfoxy group, a

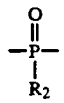

group, a

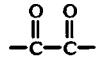

group, a thiocarbonyl group or an iminomethylene group; and $A_1$ and $A_2$ both represent a hydrogen atom, or one represents a hydrogen atom and the other represents a substituted or unsubstituted alkylsulfonyl group, a substituted or unsubstituted arylsulfonyl group, or a substituted or unsubstituted acyl group.

Suitable aliphatic groups represented by $R_1$ in formula (I) preferably have from 1 to 30 carbon atoms, and they are most preferably straight chain, branched or cyclic alkyl groups which have from 1 to 20 carbon atoms. Here, the branched alkyl groups may be cyclized in such a way that a saturated heterocyclic ring containing one or more hetero atoms is formed. Furthermore, the alkyl group may be substituted, for example, with aryl, alkoxy, sulfoxy, sulfonamido or carboxamido groups.

Examples of aromatic groups represented by $R_1$ in formula (I) are monocyclic or bicyclic aryl groups having from 6 to 30 carbon atoms or unsaturated heterocyclic groups of 5-, 6- or 7-member. Here, the unsaturated heterocyclic group may be condensed with a monocyclic or a bicyclic aryl group to form hetero aryl group. Appropriate hetero atoms are oxygen, nitrogen and sulfur.

For example, $R_1$ may be a benzene ring, a naphthalene ring, a pyridine ring, a pyrimidine ring, an imidazole ring, a pyrazole ring, a quinoline ring, an isoquinoline ring, a benzimidazole ring, a thiazole ring, or a benzothiazole ring and, of these, those which contain a benzene ring are preferred.

Aryl groups are especially preferred for $R_1$.

Suitable aryl groups or unsaturated heterocyclic groups represented by $R_1$ may be substituted, and typical substituents include, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carboxamido group, a sulfonamido group, a carboxyl group, a phosphoric acid amido group, a diacylamino group, an imido group, and an

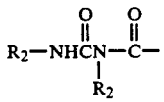

group. Preferred substituent groups are, for example, linear chain, branched or cyclic alkyl groups (which preferably have from 1 to 20 carbon atoms), aralkyl groups (preferably monocyclic or bicyclic groups of which the alkyl moiety has from 1 to 3 carbon atoms), alkoxy groups (which preferably have from 1 to 20 carbon atoms), substituted amino groups (preferably amino groups substituted with alkyl groups which have from 1 to 20 carbon atoms), acylamino groups (which preferably have from 2 to 30 carbon atoms), sulfonamido groups (which preferably have from 1 to 30 carbon atoms), ureido groups (which preferably have from 1 to 30 carbon atoms), and phosphoric acid amido groups (which preferably have from 1 to 30 carbon atoms).

The alkyl groups represented by $R_2$ in formula (I) are preferably unsubstituted alkyl groups which have from 1 to 4 carbon atoms, and these may be substituted, for example, with a halogen atom, a cyano group, a carboxyl group, a sulfo group, an alkoxy group, a phenyl group, an acyl group, an alkoxycarbonyl group, an aryloxycarbonyl group, a carbamoyl group, an alkyl-sulfo group, an arylsulfo group, a sulfamoyl group, a nitro group, a hetero aromatic group, and an

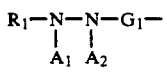

group, and these substituent groups may also be substituted groups.

The aryl groups are preferably monocyclic or bicyclic aryl groups having from 6 to 30 carbon atoms, for example, groups which contain a benzene ring. These aryl groups may be substituted, for example, with the same substituent groups as described above in connection with the alkyl groups.

The alkoxy groups preferably have from 1 to 8 carbon atoms, and they may be substituted, for example, with a halogen atom and an aryl group.

The aryloxy groups preferably have from 6 to 20 carbon atoms and are monocyclic and the aryloxy groups may be substituted, for example, with halogen atoms.

The amino groups are preferably unsubstituted amino groups, or arylamino groups or alkylamino groups which have up to 10 carbon atoms, and they may be substituted, for example, with an alkyl group, a halogen atom, a cyano group, a nitro group and a carboxyl group.

The carbamoyl groups are preferably unsubstituted carbamoyl groups, arylcarbamoyl groups or alkylcarbamoyl groups which have up to 10 carbon atoms, and they may be substituted, for example, with an alkyl group, a halogen atom, a cyano group and a carboxyl group.

The oxycarbonyl groups are preferably aryloxycarbonyl groups or alkoxycarbonyl groups which have up to 10 carbon atoms, and they may be substituted, for example, with an alkyl group, a halogen atom, a cyano group and a nitro group.

Where $G_1$ is a carbonyl group, preferred groups for $R_2$ are, for example, a hydrogen atom, an alkyl group (for example, methyl, trifluoromethyl, 3-hydroxypropyl, 3-methanesulfonamidopropyl, phenylsulfonylmethyl), an aralkyl group (for example, o-hydroxybenzyl) and an aryl group (for example, phenyl, 3,5-dichlorophenyl, o-methanesulfonamidophenyl, 4-methanesulfonylphenyl), and a hydrogen atom is especially preferred.

Furthermore, where $G_1$ is a sulfonyl group, $R_2$ is preferably an alkyl group (for example, methyl), an aralkyl group (for example, o-hydroxyphenylmethyl), an aryl group (for example, phenyl) or a substituted amino group (for example, dimethylamino).

Where $G_1$ is a sulfoxy group, $R_2$ is preferably a cyanobenzyl group, or a methylthiobenzyl group, and where $G_1$ is a

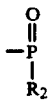

group, $R_2$ is preferably a methoxy group, an ethoxy group, a butoxy group, a phenoxy group or a phenyl group, and $R_2$ is most preferably a phenoxy group.

Where $G_1$ represents an N-substituted or unsubstituted iminomethylene group, $R_2$ is preferably a methyl group, an ethyl group or a substituted or unsubstituted phenyl group.

The substituent groups described in connection with $R_1$ are appropriate substituent groups for $R_2$ as well.

$G_1$ in formula (I) is most preferably a carbonyl group.

Furthermore, $R_2$ may be a group such that the $G_1$-$R_2$ moiety is cleaved from the rest of the molecule and a cyclization reaction occurs, forming a ring structure which contains the atoms of the $—G_1—R_2$ moiety, and specifically this may be represented by the formula (a) below:

$$—R_3—Z_1 \qquad \text{(a)}$$

wherein $Z_1$ is a group which nucleophilically attacks $G_1$ and cleaves the $G_1—R_3—Z_1$ moiety from the rest of the molecule and $R_3$ is a group derived by removing a hydrogen atom from $R_2$, and $Z_1$ can nucleophilically attack $G_1$ and form a ring structure with $G_1$, $R_3$ and $Z_1$.

More specifically, $Z_1$ is a group which, when the reaction intermediate $R_1—N{=}N—G_1—R_3—Z_1$ has been formed by the oxidation of the hydrazine compound of formula (I), for example, readily undergoes a nucleophilic reaction with $G_1$ and causes the $R_1—N{=}N—$ group to be cleaved from $G_1$, and specifically it may be a functional group (wherein $R_4$ is a hydrogen atom, an alkyl group, an aryl group, $—COR_5$ or $—SO_2R_5$, wherein $R_5$ represents a hydrogen atom, an alkyl group, an aryl group or a heterocyclic group, for example), or —COOH, for example, (the —OH, —SH, $—NHR_4$, —COOH groups in this case may be temporarily protected in such a way that these groups are formed by hydrolysis with an alkali, for example), or a functional group which reacts with $G_1$ as a result of the reaction of a nucleophile such as hydroxide ion or sulfite ion, such as

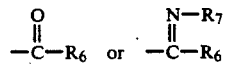

(wherein $R_6$ and $R_7$ represent hydrogen atoms, alkyl groups, alkenyl groups, aryl groups or heterocyclic groups).

Furthermore, the ring formed by $G_1$, $R_3$ and $Z_1$ is preferably a 5- or 6-membered ring containing hetero atoms.

Groups represented by formula (a) which are represented by formulae (b) and (c) below are preferred.

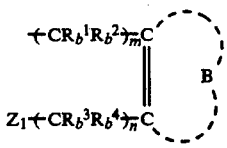

(b)

wherein $R_b^1$ to $R_b^4$ represent, for example, hydrogen atoms, alkyl groups (which preferably have from 1 to 12 carbon atoms), alkenyl groups (which preferably have from 2 to 12 carbon atoms), or aryl groups (which preferably have from 6 to 12 carbon atoms), and they may be the same or different. B represents the atoms required to complete a 5- or 6-membered ring which may be substituted; m and n represent 0 or 1, and (m+n) has a value of 1 or 2.

Specific examples of 5- or 6-membered rings formed by B include a cyclohexene ring, a cyclopentene ring, a benzene ring, a naphthalene ring, a pyridine ring, and a quinoline ring.

$Z_1$ has the same meaning as in formula (a).

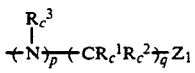

(c)

wherein $R_c^1$ and $R_c^2$ represent, for example, hydrogen atoms, alkyl groups (which preferably have from 1 to 12 a halogen atom, and they may be the same or different. $R_c^3$ represents a hydrogen atom, an alkyl group, an alkenyl group or an aryl group.

Moreover, p represents 0 or 1, and q represents 1, 2, 3 or 4.

$R_c^1$, $R_c^2$ and $R_c^3$ may combine and form a ring, provided that the structure permits an intramolecular nucleophilic attack by $Z_1$ on $G_1$.

$R_c^1$ and $R_c^2$ are preferably a hydrogen atom, a halogen atom or an alkyl group, and $R_c^3$ is preferably an alkyl group or an aryl group.

Moreover, q preferably is 1 to 3, and when q is 1, p is 1 or 2; when q is 2, p is 0 or 1; and when q is 3, p is 0 or 1. Moreover, when q is 2 or 3, the $R_c^1$ and $R_c^2$ groups may be the same or different. $Z_1$ has the same meaning as in formula (a).

$A_1$ and $A_2$ represent hydrogen atoms, alkylsulfonyl groups and arylsulfonyl groups (preferably phenylsulfonyl groups or substituted phenylsulfonyl groups in which the sum of the Hammett substituent constants is at least −0.5) which have 20 or less carbon atoms, acyl groups which have 20 or less carbon atoms (preferably benzoyl groups or substituted benzoyl groups in which the sum of the Hammett substituent constants is at least −0.5, or linear chain, branched or cyclic unsubstituted or substituted aliphatic acyl groups (with halogen atoms, ether groups, sulfonamido groups, carboxamido groups, hydroxyl groups, carboxyl groups or sulfonic acid groups as substituent groups)).

$A_1$ and $A_2$ are most preferably hydrogen atoms.

The groups represented by $R_1$ or $R_2$ in formula (I) may include ballast groups or they may be polymers as normally used in immobile photographically useful additives such as couplers. Ballast groups are groups which are comparatively inert in the photographic sense and which have at least 8 carbon atoms. They can be selected, for example, from alkyl groups, alkoxy groups, phenyl groups, alkylphenyl groups, phenoxy groups, and alkylphenoxy groups. Furthermore, those disclosed, for example, in JP-A-1-100530 are examples of polymers.

$R_1$ or $R_2$ in formula (I) may include a group which is adsorbed strongly on silver halide grain surfaces. Examples of suitable adsorbing groups include thiourea groups, heterocyclic thioamido groups, mercapto heterocyclic groups, and triazole groups disclosed, for example, in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

Specific examples of compounds represented by formula (I) are shown below, but the present invention is not to be construed as being limited to these compounds.

(I-1)

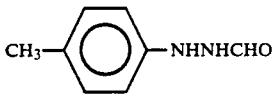

(I-2)

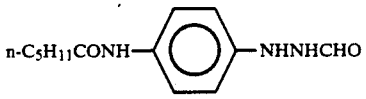

(I-3)

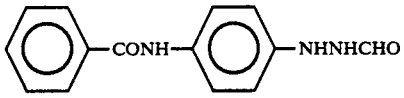

(I-4)

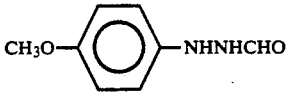

(I-5)

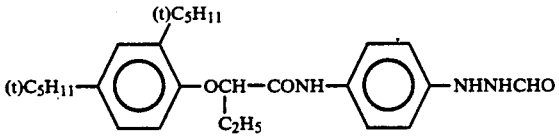

(I-6)

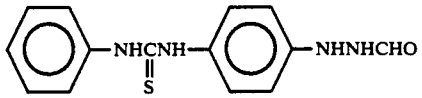

-continued
(I-7)
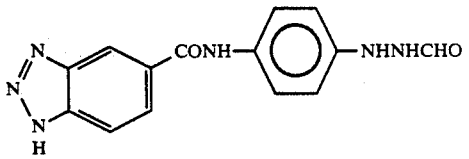
(I-8)
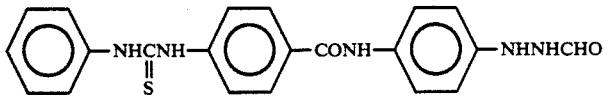
(I-9)
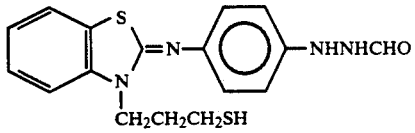
(I-10)
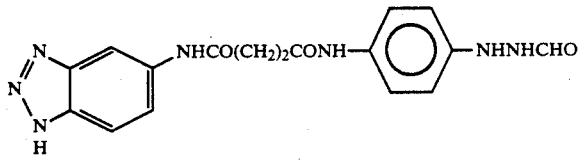
(I-11)
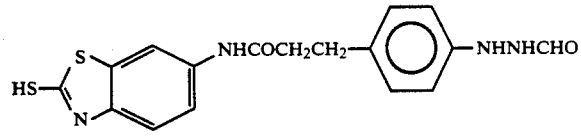
(I-12)
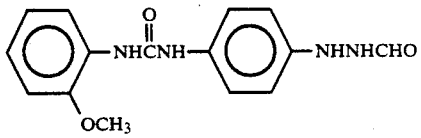
(I-13)
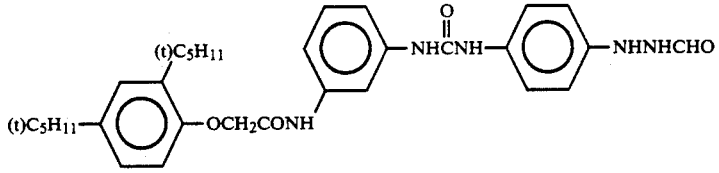
(I-14)
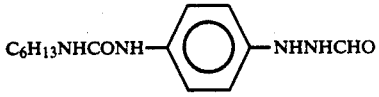
(I-15)
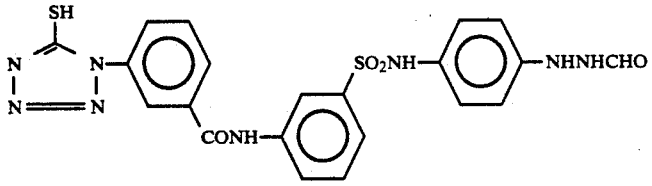
(I-16)
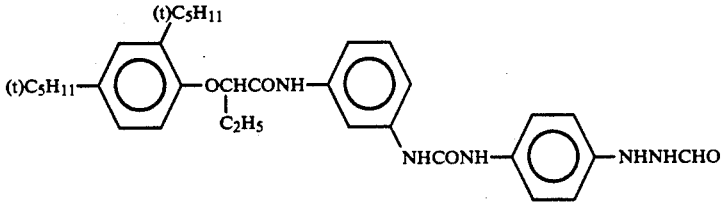

-continued
(I-17)
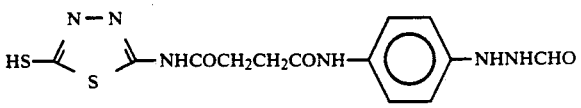
(I-18)
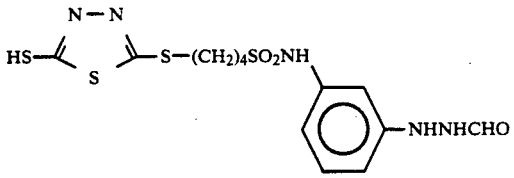
(I-19)
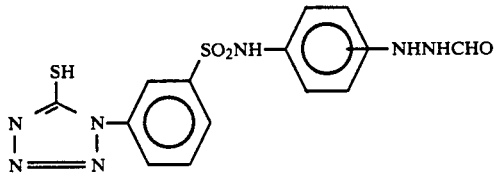
(I-20)
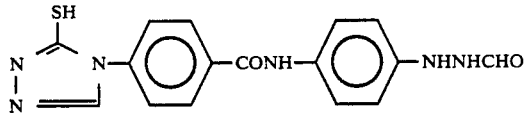
(I-21)
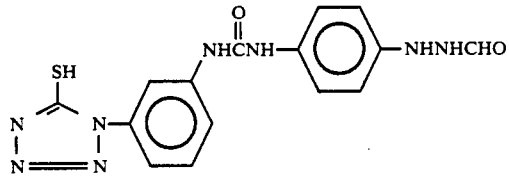
(I-22)
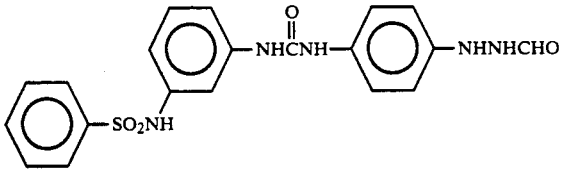
(I-23)
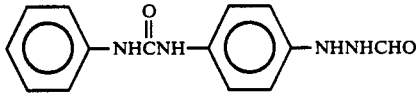
(I-24)
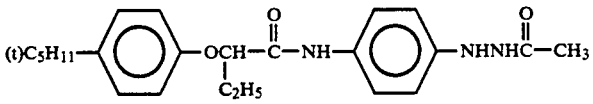
(I-25)
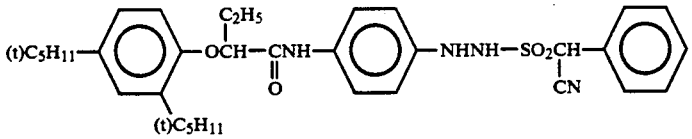
(I-26)
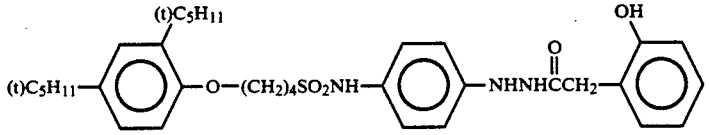

-continued
(I-27)
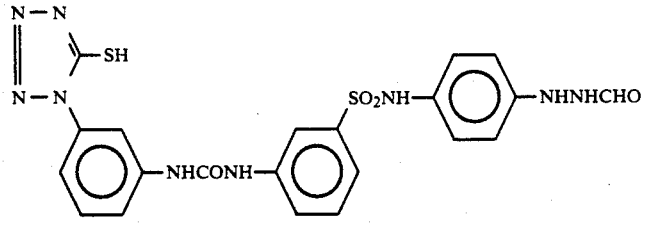
(I-28)
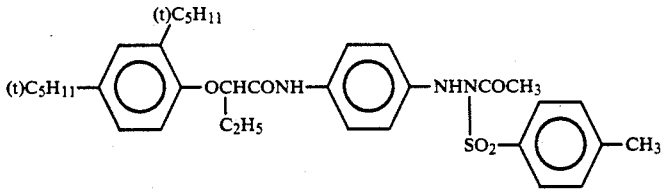
(I-29)
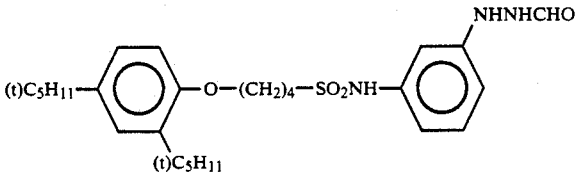
(I-30)
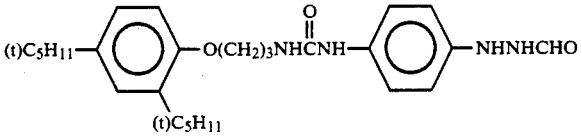
(I-31)
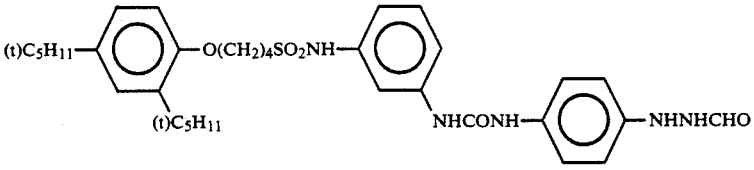
(I-32)
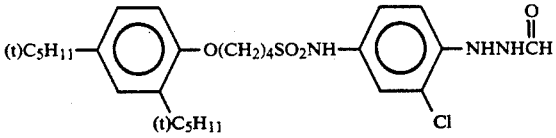
(I-33)
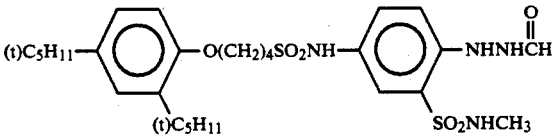
(I-34)
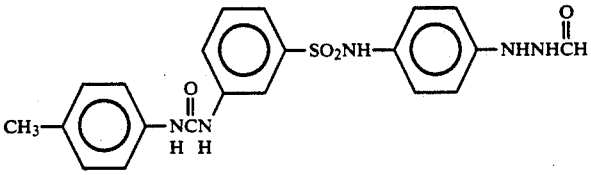

-continued
(I-35)
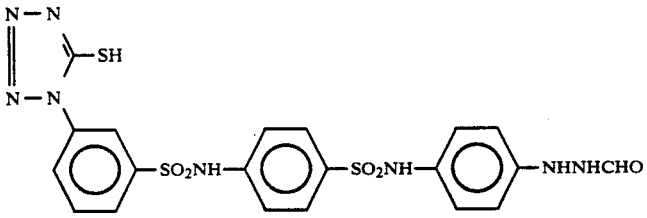
(I-36)
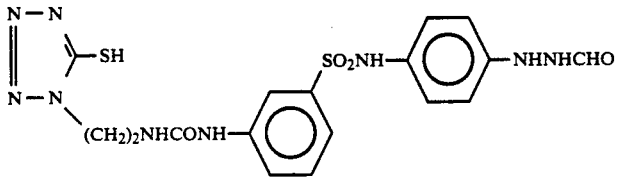
(I-37)
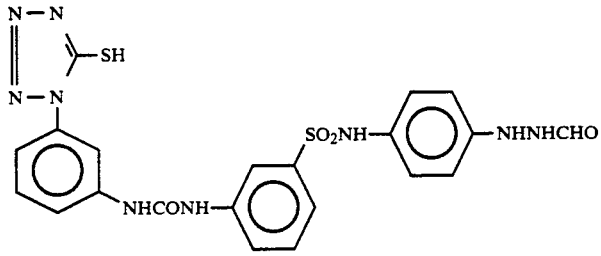
(I-38)
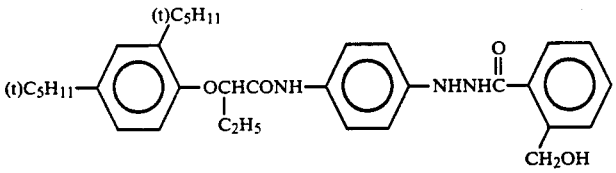
(I-39)
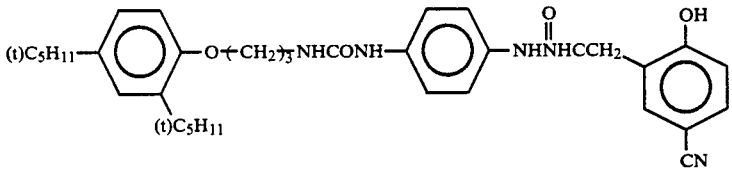
(I-40)
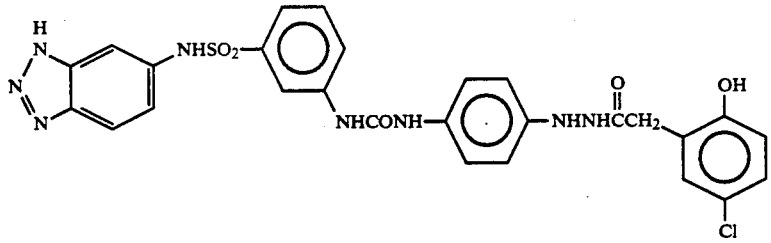
(I-41)
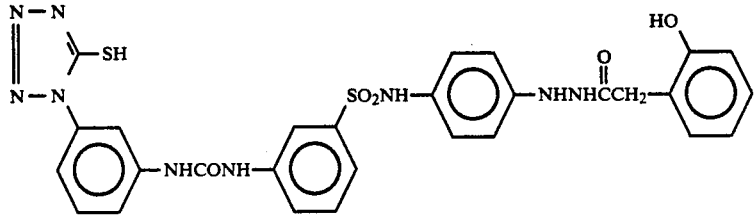

-continued
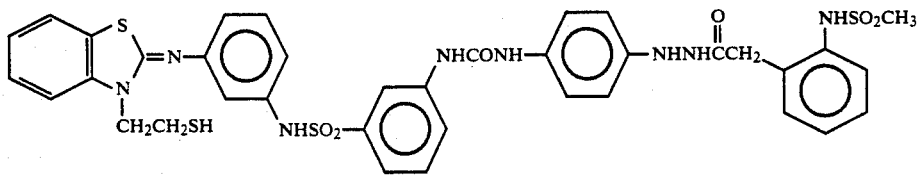
(I-42)
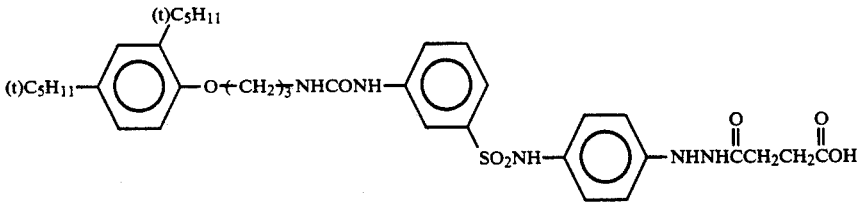
(I-43)
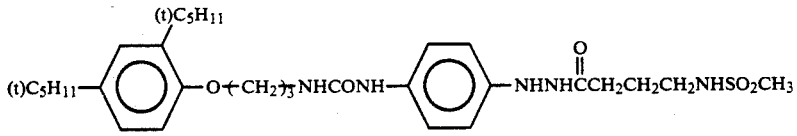
(I-44)
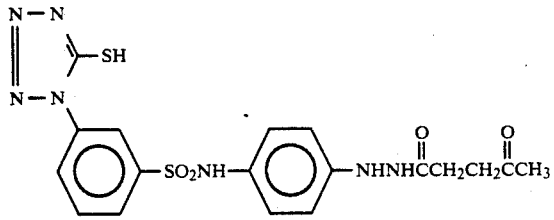
(I-45)
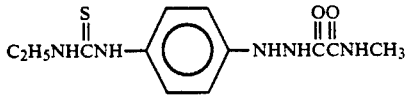
(I-46)
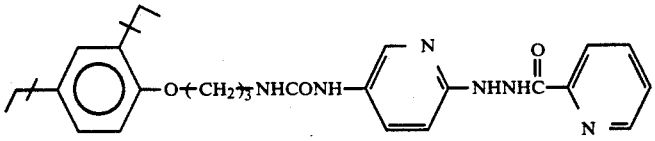
(I-47)
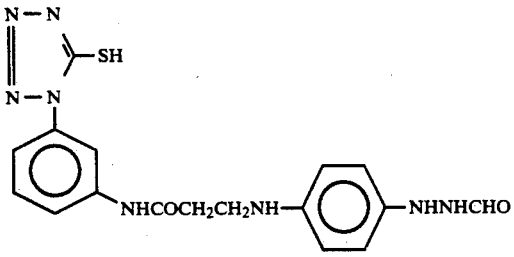
(I-48)
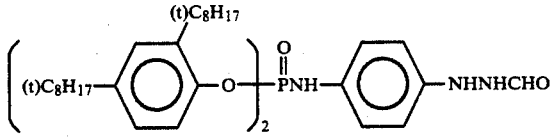
(I-49)

-continued
(I-50)
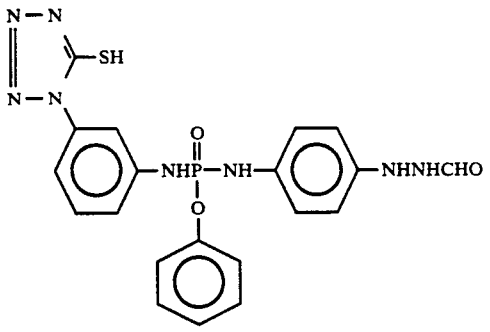
(I-51)
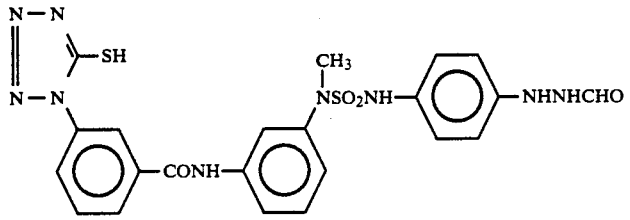
(I-52)
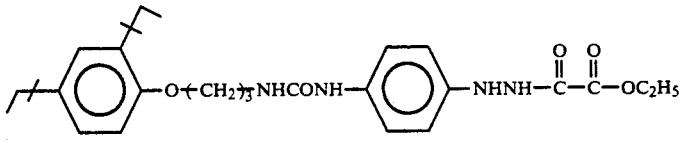
(I-53)
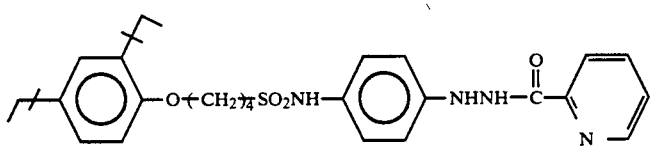
(I-54)
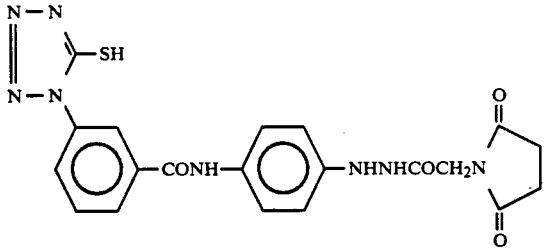
(I-55)
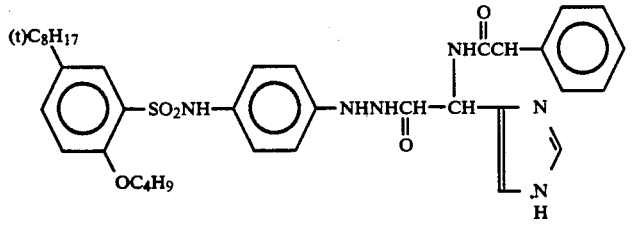
(I-56)
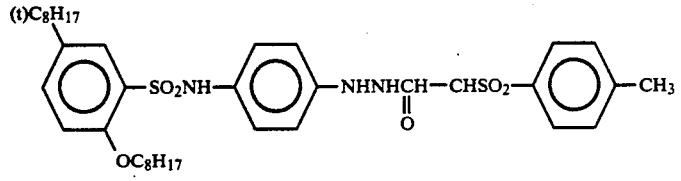

-continued (I-57)

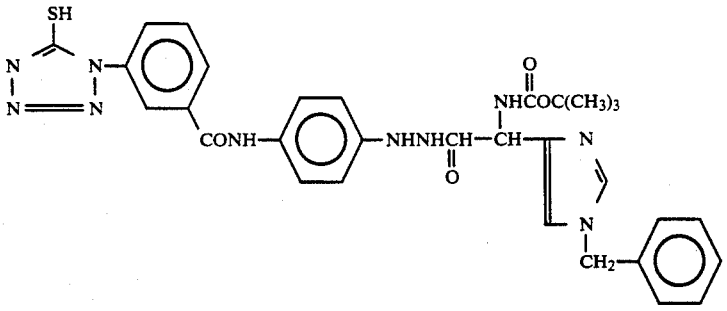

(I-58)

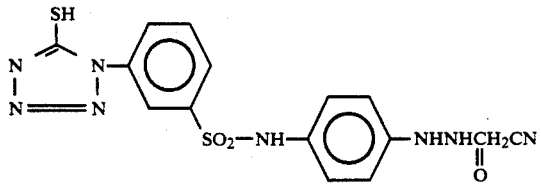

(I-59)

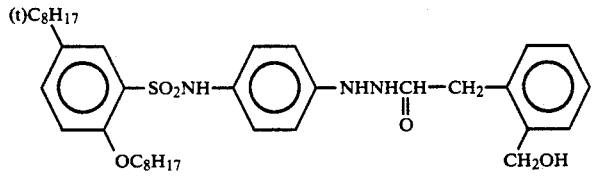

(I-60)

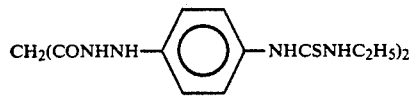

(I-61)

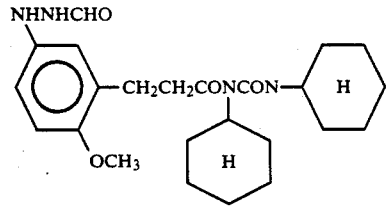

(I-62)

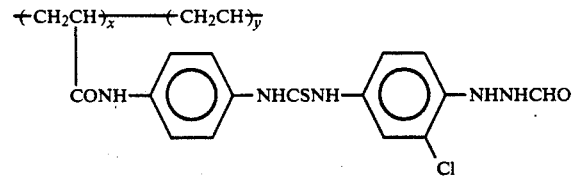

x:y = 97:3

The hydrazine derivatives which can be used in the present invention include, in addition to those described above, those disclosed in *Research Disclosure*, Item 23516 (November, 1983, page 346) and in the literature cited therein, and in U.S. Pat. Nos. 4,080,207, 4,269,929, 4,276,364, 4,278,748, 4,385,108, 4,459,347, 4,560,638 and 4,478,928, British Patent 2,011,391B, JP-A-60-179734, JP-A-62-270948, JP-A-63-29751, JP-A-61-170733, JP-A-61-270744, JP-A-62-948, EP 217,310, or U.S. Pat. No. 4,686,167, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941 and JP-A-1-105943, JP-A-64-10233, JP-A-1-90439, JP-A-1-276128, JP-A-1-283548, JP-A-1-280747, JP-A-1-283549, JP-A-1-285940, JP-A-2-2541, JP-A-2-77057, and Japanese Patent Application Nos. 63-179760, 1-18377, 1-18378, 1-18379, 1-15755, 1-16814, 1-40792, 1-42615, 1-42616, 1-23693, and 1-126284.

The amount of the hydrazine derivative employed in the present invention is preferably from $1\times10^{-6}$ mol to $5\times10^{-2}$ mol, and most preferably from $1\times10^{-5}$ mol to $2\times10^{-2}$ mol, per mol of silver halide.

When a compound represented by formula (I) is present in a photographic photosensitive material it should be added to the silver halide emulsion or to the hydrophilic colloid solution as an aqueous solution if it is water-soluble or as a solution in an organic solvent which is miscible with water, such as an alcohol (for example, methanol, ethanol), an ester (for example, ethyl acetate), or a ketone (for example, acetone), if it is not soluble in water.

When the addition is made to a silver halide emulsion, the addition can be made at any time from the beginning of chemical ripening and before coating, but it is preferably added after the completion of the chemical ripening, and most preferably the addition is made to the coating liquid which has been prepared for coating.

In the present invention, the pH of the developer is preferably from 9.5 to 12.3, but when development is carried out at from pH 9.5 to pH 11.2, compounds represented by formulae (II) and/or (III) below are preferably present in the light-sensitive material. The compounds represented by formulae (II) and (III) may or may not be present when development is carried out at a pH within the range from 11.2 to 12.3.

$$Y-[(X)_n-A-B]_m \qquad \text{(II)}$$

wherein Y represents a group which is adsorbed on silver halide; X represents a divalent linking group comprising an atom or group of atoms including hydrogen, carbon, nitrogen, oxygen and sulfur atoms; A represents a divalent linking group; B represents an amino group, an ammonium group, or a nitrogen-containing heterocyclic group, and the amino group may be a substituted amino group; m represents 1, 2 or 3; and n represents 0 or 1.

Nitrogen-containing heterocyclic compounds are examples of groups which are adsorbed on silver halide and represented by Y.

Where Y represents a nitrogen-containing heterocyclic ring, the compounds of formula (II) can be represented by formula (II-a) shown below:

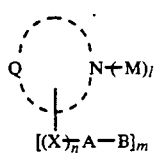

(II-a)

wherein l represents 0 or 1, m represents 1, 2 or 3, and n represents 0 or 1.

$[(X)_n-A-B]m$ is the same as that in the above described formula (II), and Q represents a group of atoms required to form a 5- or 6-membered heterocyclic ring which includes at least one of an atom selected from carbon, nitrogen, oxygen and sulfur atoms. Furthermore, this heterocyclic ring may be condensed with a carbocyclic aromatic ring or a heterocyclic aromatic ring.

The heterocyclic ring formed by Q may be, for example, a substituted or unsubstituted indazole, benzimidazole, benzotriazole, benzoxazole, benzothiazole, imidazole, thiazole, oxazole, triazole, tetrazole, azaindene, pyrazole, indole, triazine, pyrimidine, pyridine, or quinoline.

M represents a hydrogen atom, an alkali metal atom, an ammonium group, or a group which converted to a hydrogen atom or an alkali metal atom under alkaline conditions.

Furthermore, these heterocyclic rings may be substituted, for example, with nitro groups, halogen atoms, mercapto groups, cyano groups, and substituted and unsubstituted alkyl groups, aryl groups, alkenyl groups, aralkyl groups, alkoxy groups, aryloxy groups, alkylthio groups, arylthio groups, sulfonyl groups, carbamoyl groups, sulfamoyl groups, carboxamido groups, sulfonamido groups, acyloxy groups, sulfonyloxy groups, ureido groups, thioureido groups, acyl groups, heterocyclic groups, oxycarbonyl groups, oxycarbonylamino groups, amino groups, carboxylic acid groups or salts thereof, sulfonic acid groups or salts thereof, or hydroxyl groups.

The divalent linking group represented by X may may be, for example,

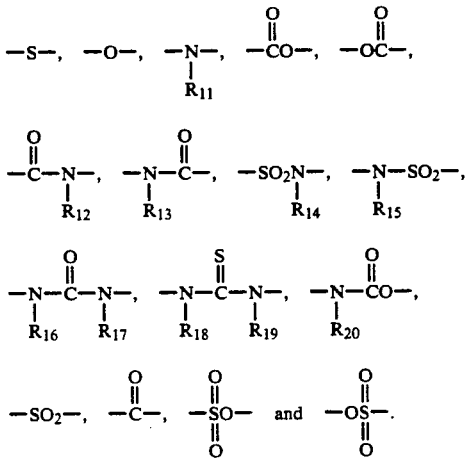

These linking groups may be bonded to Q via a linear chain or branched alkylene group. $R_{11}$, $R_{12}$, $R_{13}$, $R_{14}$, $R_{15}$, $R_{16}$, $R_{17}$, $R_{18}$, $R_{19}$ and $R_{20}$ each represents a hydrogen atom, a substituted or unsubstituted alkyl group, a substituted or unsubstituted aryl group, a substituted or unsubstituted alkenyl group, or a substituted or unsubstituted aralkyl group.

A represents a divalent linking group, and the divalent linking group may be, for example, a linear chain or branched alkylene group, a linear chain or branched alkenylene group, a linear chain or branched aralkylene group or an arylene group. The above described groups represented by A may be further substituted with any combinations of A and X.

The substituted or unsubstituted amino group of B is a group represented by formula (II-b):

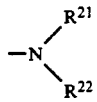

(II-b)

wherein $R^{21}$ and $R^{22}$ may be the same or different, and each represents a hydrogen atom, a substituted or unsubstituted alkyl, alkenyl or aralkyl group having from 1 to 30 carbon atoms, and these groups may be linear chain groups, branched groups or cyclic groups.

Furthermore, $R^{21}$ and $R^{22}$ may combine and form a ring, and they may be cyclized in such a way as to form a saturated heterocyclic ring which contains one or more hetero atoms within the ring. Examples include a pyrrolidyl group, a piperidyl group and a morpholino group. Furthermore, examples of substituents for $R^{21}$ and $R^{22}$ include a carboxyl group, a sulfo group, a cyano group, a halogen atom, a hydroxyl group, an alkoxycarbonyl group containing 20 or less carbon atoms, an alkoxy group containing 20 or less carbon atoms, a monocyclic aryloxy group containing 20 or less carbon atoms, an acyloxy group containing 20 or less carbon atoms, an acyl group containing 20 or less carbon atoms, a carbamoyl group, a sulfamoyl group, an acylamino group containing 20 or less carbon atoms, a sulfonamido group, a carboxamido group containing 20 or less carbon atoms, a ureido group containing 20 or less carbon atoms and an amino group.

The ammonium groups of B are groups which can be represented by formula (II-c)

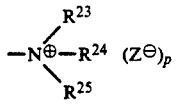

(II-c)

wherein $R^{23}$, $R^{24}$ and $R^{25}$ are the same groups as $R^{21}$ and $R^{22}$ in formula (II-b) described above; and $Z^{\ominus}$ represents an anion.

The heterocyclic rings represented by B are 5-or 6-membered rings which contain at least one nitrogen atom, and these rings may have substituent groups and may also be condensed with other rings. Examples of nitrogen-containing heterocyclic rings include an imidazolyl group, a pyridyl group and a thiazolyl group.

Preferred compounds of those represented by formula (II) are those represented by formulae (II-m), (II-n), (II-o) or (II-p).

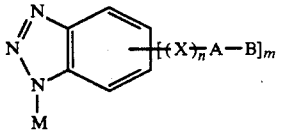

(II-m)

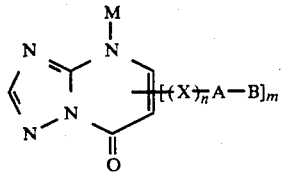

(II-n)

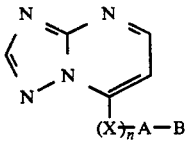

(II-o)

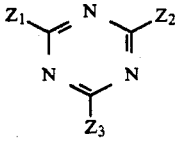

(II-p)

wherein $-(X)_n-A-B$, M and m are the same as those in the above described formula (II-a); $Z_1$, $Z_2$ and $Z_3$ are the same as $-(X)_n-A-B$ in formula (II-a), or they represent a halogen atom, an alkoxy group containing 20 or less carbon atoms (for example, methoxy), a hydroxyl group, a hydroxylamino group, or a substituted or unsubstituted amino group, and the substituent groups can be selected from among the substituent groups for $R^{21}$ and $R^{22}$ in the above described formula (II-b) However, at least one of the groups $Z^2$, $Z^2$ and $Z^3$ is the same as $-(X)_n-A-B$.

Furthermore, these heterocyclic rings can be substituted with substituent groups which can be present on the heterocyclic rings in formula (II).

Specific examples of compounds represented by formula (II) which can be used in the present invention are illustrated below, but the present invention is not to be construed as being limited to these compounds.

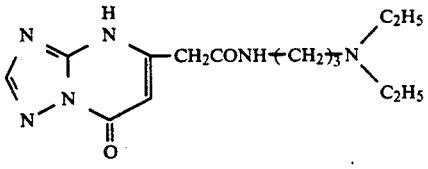

(II-1)

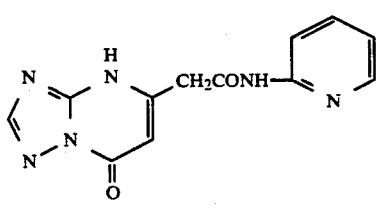

(II-2)

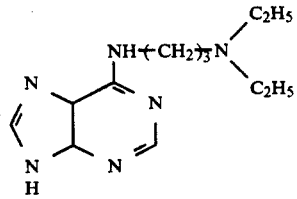

(II-3)

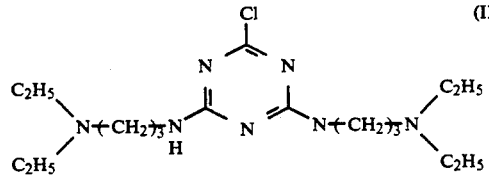

(II-4)

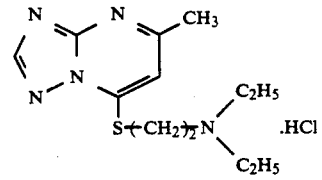

(II-5)

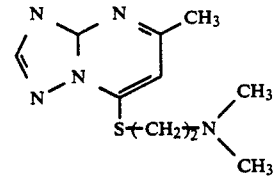

(II-6)

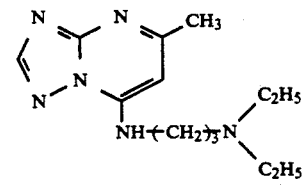

(II-7)

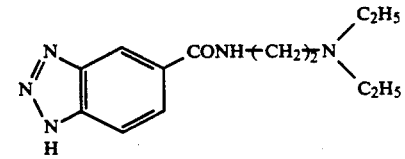

(II-8)

-continued

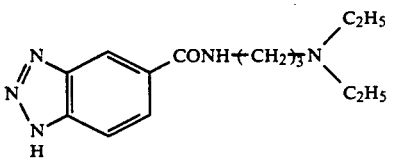

(II-9)

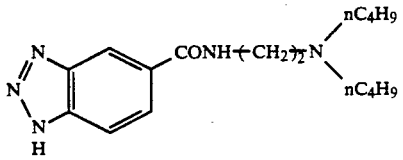

(II-10)

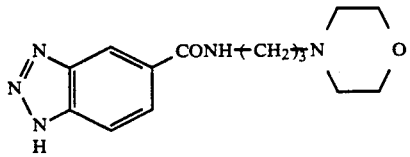

(II-11)

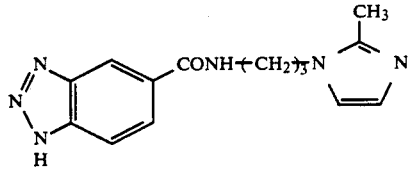

(II-12)

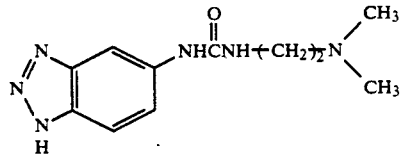

(II-13)

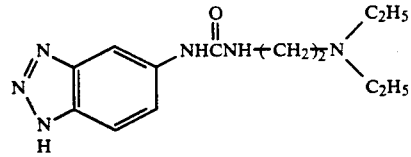

(II-14)

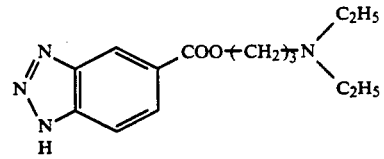

(II-15)

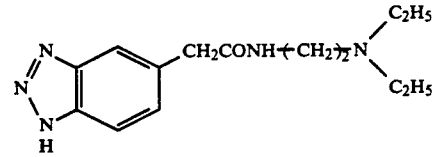

(II-16)

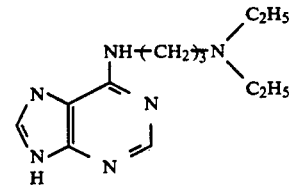

(II-17)

-continued

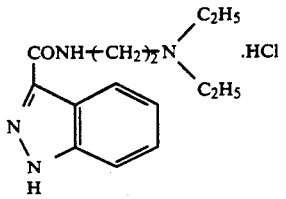

(II-18)

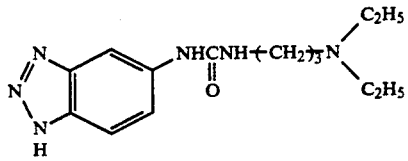

(II-19)

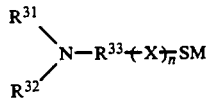

(III)

wherein $R^{31}$ and $R^{32}$ each represents a hydrogen atom or an aliphatic group, or $R^{31}$ and $R^{32}$ may combine and form a ring; $R^{33}$ represents a divalent aliphatic group; X represents a divalent nitrogen-, oxygen- or sulfur-containing heterocyclic group; n represents 0 or 1; and M represents a hydrogen atom, an alkali metal, an alkaline earth metal, a quaternary ammonium salt, a quaternary phosphonium salt, or an amidino group.

The aliphatic groups represented by $R^{31}$ and $R^{32}$ are preferably alkyl, alkenyl and alkynyl groups having from 1 to 12 carbon atoms, and these may be substituted with appropriate groups.

When $R^{31}$ and $R^{32}$ combine and form a ring, the ring is preferably a 5- or 6-membered carbocyclic or heterocyclic ring comprised of carbon or a combination of carbon with nitrogen and oxygen, and it is most preferably a saturated ring.

Most preferred groups for $R^{31}$ and $R^{32}$ are an alkyl group having from 1 to 3 carbon atoms, and an ethyl group is especially preferred.

$—R^{34}—$or $—R^{34}S—$is preferred as the divalent aliphatic group represented by $R^{33}$. Here, $R^{34}$ represents a divalent aliphatic group, and it is preferably a saturated or unsaturated aliphatic group having from 1 to 6 carbon atoms.

The heterocyclic groups represented by X are 5- or 6-membered heterocyclic rings containing nitrogen, oxygen or sulfur, and they may be condensed with a benzene ring. Preferred examples of aromatic heterocyclic rings include tetrazole, triazole, thiadiazole, oxadiazole, imidazole, thiazole, oxazole, benzimidazole, benzothiazole, and benzoxazole. Of these, tetrazole and thiadiazole are especially preferred.

Specific examples of compounds represented by formula (III) are indicated below but the present invention is not to be construed as being limited to these compounds.

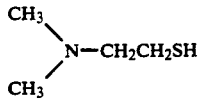

(III-1)

-continued (III-2)

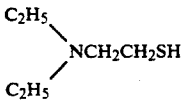

(III-3)

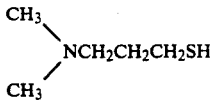

(III-4)

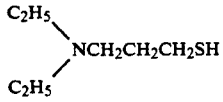

(III-5)

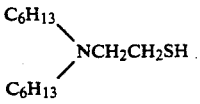

(III-6)

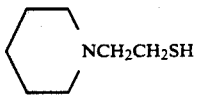

(III-7)

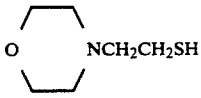

$(HOCH_2CH_2)_2NCH_2CH_2SH$ (III-8)

(III-9)

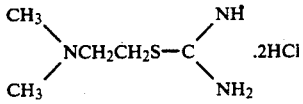

(III-10)

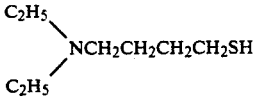

(III-11)

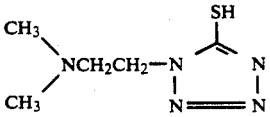

(III-12)

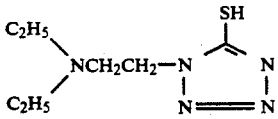

(III-13)

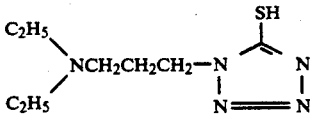

(III-14)

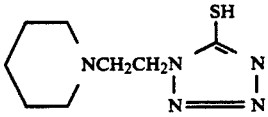

(III-15)

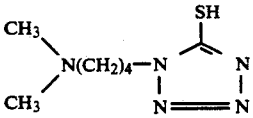

-continued (III-16)

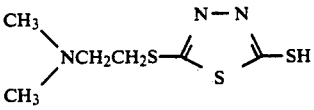

(III-17)

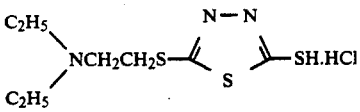

(III-18)

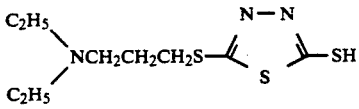

(III-19)

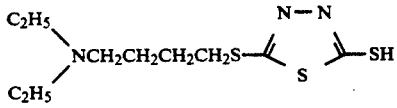

(III-20)

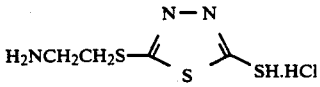

(III-21)

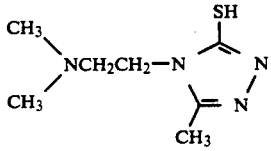

(III-22)

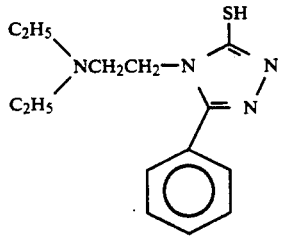

The optimum amount of these accelerators represented by formulae (II) and (III) added differs depending on the type of compounds used, but an amount within the range from $1.0\times10^{-3}$ to 0.5 g/m$^2$, and preferably within the range from $5.0\times10^{-3}$ to 0.3 g/m$^2$ is preferred. These accelerators are dissolved in an appropriate solvent (for example, $H_2O$, alcohols such as methanol and ethanol, acetone, dimethylformamide, methyl Cellosolve), and then added to the coating liquid.

Methods for the preparation of the silver halide emulsions which can be used in the present invention include the methods described by P. Glafkides in *Chimie et Physique Photographique* (published by Paul Montel, 1967), by G. F. Duffin in *Photographic Emulsion Chemistry* (published by the Focal Press,1966) and by V. L. Zelikman et al. in *Making and Coating Photographic Emulsion* (published by the Focal Press, 1964), the conversion methods disclosed, for example, in U.S. Pat. Nos. 2,592,250 and 4,075,020, and the core/shell emulsion preparation methods disclosed, for example, in British Patent 1,027,146.

The system by which the water-soluble silver salt (aqueous silver nitrate solution) is reacted with the aqueous halogen salt solution may be a single sided mixing system, a simultaneous mixing system or a combination of these systems. The method in which the pAg value in the liquid phase in which the silver halide is being formed is held constant, i.e., the controlled double jet method, can also be used as a simultaneous mixing system.

Furthermore, grain formation can also be carried out in the presence of silver halide solvents, such as ammonia, thioether and tetra-substituted thiourea, for example.

Silver halide emulsions which have a regular crystalline form and a narrow grain size distribution can be prepared easily using the controlled double jet method and the grain formation methods in which silver halide solvents are present.

The silver halide grains in the photographic emulsions used in the present invention may have a comparatively wide grain size distribution. However, emulsions which have a narrow grain size distribution are preferred, and those in which 90% of all the grains either in terms of the weight or number of silver halide grains have a grain size within ±40% of the average grain size are most preferred (emulsions of this type are generally referred to as monodisperse emulsions).

The silver halide grains used in the present invention are preferably fine grains (for example, with a grain size of not more than 0.7 μm) and grains of a grain size of not more than 0.4 μm are especially preferred.

The silver halide grains in the photographic emulsion may have a regular crystalline form such as a cubic or octahedral form, or an irregular form such as a spherical or plate-like form, or they may have a form which is a composite of these forms.

The silver halide grains may be such that the interior and surface layer comprise a uniform phase or different phases.

Mixtures of two or more silver halide emulsions which have been prepared separately can also be used.

Cadmium salts, sulfite, lead salts, thallium salts, iridium salts or complex salts thereof and rhodium salts or complex salts thereof, for example, may also be present during the formation or physical ripening of the silver halide grains in a silver halide emulsion which is to be used in the present invention.

The silver halide emulsions used in the present invention may or may not be chemically sensitized. Gold sensitization can be used as a method of chemical sensitization, and combinations of gold sensitization with sulfur sensitization, reduction sensitization and precious metal sensitization, for example, can be used.

The gold sensitization method is typical of the precious metal methods of sensitization and gold compounds, and principally gold complex salts, are used for this purpose. Complex salts of precious metals other than gold, for example, platinum, palladium and iridium, can also be included. Specific examples are disclosed, for example, in U.S. Pat. No. 2,448,060 and British Patent 618,061.

Various sulfur compounds, for example, thiosulfate, thioureas, thiazoles and rhodanines, can be used as sulfur sensitizing agents as well as the sulfur compounds present in gelatin.

Stannous salts, amines, formamidinesulfinic acid and silane compounds, for example, can be used as reduction sensitizing agents.

Moreover, the silver halide emulsions can be optically sensitized to increase the photographic speed or to provide photosensitivity in a prescribed wavelength region. Sensitizing dyes such as cyanine dyes and merocyanine dyes, for example, can be used individually or in combination for optical sensitization purposes, and spectral sensitization and supersensitization can be achieved.

These techniques are disclosed, for example, in U.S. Pat. Nos. 2,688,545, 2,912,329, 3,397,060, 3,615,635 and 3,628,964, JP-B-43-4936, JP-B-44-14030 and JP-A-55-52050 (the term "JP-B" as used herein refers to an "examined Japanese patent publication").

Various compounds can be present in the photographic emulsions used in the present invention to prevent the occurrence of fogging during the manufacture, storage or photographic processing of the photosensitive material, or to stabilize the photographic performance. Thus, compounds which are known as antifogging agents or stabilizers, such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole); mercaptopyrimidines; mercaptotriazines; thioketo compounds such as oxazolinethione, for example; azaindenes, for example, triazaindenes, tetraazaindenes (especially 4-hydroxy-substituted (1,3,3*a*,7)tetraazaindenes), and pentaazaindenes; benzenethiosulfonic acid, benzenesulfinic acid and benzenesulfonic acid amide, for example, can be used for this purpose.

Of these materials, the benzotriazoles (for example, 5-methylbenzotriazole) and the nitroindazoles (for example, 5-nitroindazole) are preferred. Furthermore, these compounds may be present in the processing bath.

Inorganic or organic film hardening agents may be present in the photographic emulsion layers and other hydrophilic colloid layers of a photographic photosensitive material of the present invention. For example, aldehydes (for example, formaldehyde, glutaraldehyde), N-methylol compounds (for example, dimethylolurea), active vinyl compounds (for example, 1,3,5-triacryloylhexahydro-s-triazine, 1,3-vinylsulfonyl-2-propanol), active halogen compounds (for example, 2,4-dichloro-6-hydroxy-s-triazine), and mucohalogenic acids (for example, mucochloric acid), either individually or in combination can be present.

Various surfactants can be included for various purposes in the photographic emulsion layers or other hydrophilic layers of photosensitive materials for use in the present invention, for example, as coating promotors or as antistatic agents, for improving slip properties, for emulsification and dispersion purposes, for prevention of sticking and for improving photographic performance (for example, accelerating development, increasing contrast or increasing speed).

For example, nonionic surfactants, such as saponin (steroid based), alkylene oxide derivatives (for example, polyethylene glycol, polyethylene glycol/polypropylene glycol condensate, polyethylene glycol alkyl ethers or polyethylene glycol aryl alkyl ethers, polyethylene glycol esters, polyethylene glycol sorbitan esters, polyethylene glycol alkyl amines or amides, and poly(ethylene oxide) adducts of silicones), glycidol derivatives (for example, alkenylsuccinic acid polyglycerides, alkylphenol polyglycerides), fatty acid esters of polyhydric alcohols and sugar alkyl esters; anionic surfactants which contain acidic groups, such as carboxylic acid groups, sulfo groups, phospho groups, sulfate ester groups and phosphate ester groups, for example, alkylcarboxylates, alkylsulfonates, alkylbenzenesulfonates, alkylnaphthalenesulfonates, alkylsulfate esters, alkylphosphate esters, N-acyl-N-alkyltaurines, sulfosuccinate esters, sulfoalkylpolyoxyethylene alkylphenyl ethers and polyoxyethylenealkylphosphate esters; amphoteric surfactants, such as amino acids, aminoalkylsulfonic acids, aminoalkyl sulfate or phosphate esters, alkylbetaines and amine oxides, and cationic surfactants such as alkylamine salts, aliphatic and aromatic quaternary ammonium salts, heterocyclic quaternary ammonium salts, for example, pyridinium salts and imidazolium salts, and phosphonium salts and sulfonium salts which contain aliphatic or heterocyclic rings can be employed.

The polyalkylene oxides of a molecular weight of at least 600 as disclosed in JP-B-58-9412 are preferred surfactants for use in the present invention.

Dispersions of water-insoluble or sparingly soluble synthetic polymers can be present in a photosensitive material which is used in the present invention to improve the dimensional stability of the photographic emulsion layer and the other hydrophilic colloid layers. For example, polymers in which alkyl (meth)acrylates, alkoxyalkyl (meth)acrylates, glycidyl (meth)acrylates, (meth)acrylamides, vinyl esters (for example, vinyl acetate), acrylonitrile, olefins or styrenes, for example, either individually or in combination, form the monomer units, or polymers in which combinations of these with acrylic acid or methacrylic acid, $\alpha,\beta$-unsaturated dicarboxylic acids, hydroxyalkyl (meth)acrylates, sulfoalkyl (meth)acrylates, or styrenesulfonic acid, for example, form the monomer units, can be used.

Polyester films containing elemental antimony and magnesium and/or zinc and phosphorus in such a way as to satisfy equations (1) to (5) below are preferred for the supports which are used in the present invention.

$$50 \leqq Sb + P - Zn \leqq = 250 \quad (1)$$

$$50 \leqq 2Mg + 1.5Zn - P \leqq 200 \quad (2)$$

$$-30 \leqq -0.2Sb + Mg + Zn - P \leqq 30 \quad (3)$$

$$100 \leqq Sb \leqq 200 \quad (4)$$

$$1.3 \leqq 0.7 \times + Y - Z \leqq 4 \quad (5)$$

wherein Sb, Mg, Zn and P show the elemental concentrations (ppm) of antimony, magnesium, zinc and phosphorus, respectively, in the polyester. Furthermore, X indicates the number of gram atoms of elemental antimony per $10^6$ g of polyester (gram atom/$10^6$ g), Y indicates the number of gram atoms of elemental magnesium and/or zinc per $10^6$ g of polyester (gram atom/$10^6$ g) and Z represents the number of gram atoms of elemental phosphorus per $10^6$ g (gram atom/$10^6$ g).

Suitable polyesters are polyesters which have an aromatic dibasic acid and a glycol as the principal structural components and poly(ethylene terephthalate) (PET) is most commonly used since it is easily obtained. As a result, the use of PET is described below.

If the amount of elemental antimony in the polyester composition is reduced, the amount of antimony metal is reduced and the b value (degree of yellowness, JIS-Z-7103) of the polyester chips decreases. In this case, there is a tendency for the amount of ultraviolet absorption to increase. An elemental antimony content of at least 100 ppm is required to prevent a decrease in the b value of the polyester chips and to suppress the increase in ultraviolet absorption. (The b value is measured using a direct color comparator model CDE-CH-1 made by Suga Shikenki, and the ultraviolet absorption was measured using a Hitachi 150-20 spectrophotometer).

Furthermore, with antimony metal in the film, when filtering at a flow rate of 10 to 30 g/m2 with a nominal 3 to 30 micron filter in the polyester film manufacturing process the antimony aggregates can flow out into the polyester film and an antimony content of not more than 200 ppm is required in order to provide long term suppression.

Furthermore, increasing the magnesium and/or zinc content inevitably promotes a deterioration of the polyester, the b value (yellowness) increases, the ultraviolet absorption increases and inevitably results in an increased number of carboxyl groups. Increasing the elemental antimony content promotes the deterioration of the polyester to some extent. Furthermore, increasing the elemental phosphorus acts to inhibit deterioration. However, increasing the amounts of elemental antimony, magnesium, zinc has the effect of reducing the amount of antimony metal in the polyester. Conversely, reducing the elemental phosphorus inevitably reduces the amount of antimony metal in the polyester and so it is necessary to satisfy the equations indicated below in order to satisfy both factors.

Moreover, considering electrostatic applicability, there is an increase in the electrostatic applicability with an increase in elemental antimony, magnesium and zinc and a reduction in elemental phosphorus in the proportions 0.7:1:1 in terms of the numbers of gram atoms and so it is necessary to satisfy the following equations.

$$-30 \leqq -0.2Sb + Mg + Zn - P \leqq 30$$

$$50 \leqq Sb + P - Zn \leqq 250$$

$$50 \leqq 2Mg + 1.5Zn - P \leqq 200$$

$$1.3 \leqq 0.7K + Y - Z \leqq 4$$

The polyester support preferably has an underlayer to increase the strength of adhesion with the photosensitive layers, etc., which is established thereon by coating.

Underlayers in which a polymer latex comprising a styrene/butadiene based copolymer or a vinylidene chloride based copolymer is used and underlayers in which a hydrophilic binder such as gelatin is used can be employed as underlayers.

Water-soluble polymers, cellulose esters, latex polymers, and water-soluble polyesters are examples of suitable hydrophilic binders. Examples of water-soluble polymers include gelatin, gelatin derivatives, casein, agar, sodium alginate, starch, poly(vinyl alcohol), acrylic acid copolymers and maleic anhydride copolymers, and examples of cellulose esters include carboxymethyl cellulose and hydroxyethyl cellulose. Suitable polymer latexes include vinyl chloride-containing copolymers, vinylidene chloride-containing copolymers, acrylic acid esters-containing copolymers, vinyl acetate-containing copolymers and butadiene-containing copolymers. Of these materials, gelatin is the most preferred.

Resorcinol and p-chlorophen-ol, for example, can be used as compounds which swell the support.

Various gelatin hardening agents can be used in the underlayer. Fine inorganic particles of $SiO_2$ or $TiO_2$, for example, or fine particles of poly(methyl methacrylate)

copolymers (particle size: 1 to 10 μm) can be present in the underlayer as matting agents.

The use of processing baths which contain dihydroxybenzene developing agents as the main developing agent and p-aminophenol developing agents or 3-pyrazolidone developing agents as auxiliary developing agents is preferred in the present invention.

Examples of dihydroxybenzene developing agents which can be used in the present invention include hydroquinone, chlorohydroquinone and bromohydroquinone, for example, but the use of hydroquinone compounds is preferred.

Examples of 1-phenyl-3-pyrazolidones and derivatives thereof which can be used as auxiliary developing agents include 1-phenyl-3-pyrazolidone and 1-phenyl-4,4-dimethyl-3-pyrazolidone.

Examples of p-aminophenol auxiliary developing agents which can be used include N-methyl-p-aminophenol, p-aminophenol, and N-(β-hydroxyethyl)-p-aminophenol, for example, and N-methyl-p-aminophenol-is preferred.

Generally, the dihydroxybenzene developing agent is present preferably in an amount of from 0.05 to 0.8 mol/liter. Furthermore, where combinations of dihydroxybenzenes and 1-phenyl-3-pyrazolidones, or p-aminophenols are used, the former are preferably used at a concentration of from 0.05 to 0.5 mol/liter, and the latter are preferably used at a concentration of not more than 0.06 mol/liter.

Sodium sulfite, potassium sulfite, lithium sulfite, sodium bisulfite, potassium metabisulfite, or formaldehyde/sodium sulfite, for example, can be used as a sulfite preservative which is used in the present invention. The sulfite is used at a concentration of at least 0.3 mol/liter, but if too large an amount is employed it precipitates in the developer and causes contamination of the liquid. Thus, an upper limit of 1.2 mol/liter is preferred.

Amine compounds, and especially the compounds disclosed in U.S. Pat. No. 4,269,929, can be present as development accelerators in the developer used in the present invention.

pH buffers such as boric acid, borax, sodium triphosphate, potassium triphosphate, and the pH buffers disclosed in JP-A-60-93433 can also be used in the developer in the present invention.

Development inhibitors such as potassium bromide and potassium iodide; organic solvents such as ethylene glycol, diethylene glycol, triethylene glycol, dimethylformamide, methyl Cellosolve, hexylene glycol, ethanol and methanol; and antifogging agents and black pepper preventing agents such as imidazole compounds such as 5-nitroimidazole, 2-mercaptobenzimidazole-5-sulfonic acid, sodium salt, and triazole compounds such as 5-methylbenzotriazole may be employed. When compounds such as 5-nitroimidazole in particular are used, they are generally dissolved beforehand in a part other than the part which contains the dihydroxybenzene based developing agent and the sulfite preservative and the parts are mixed together and water is added for use. Moreover, the part in which the 5-nitroimidazole has been dissolved turns yellow under alkaline conditions and this is convenient for handling, etc.

Moreover, toners, surfactants, water softeners and film hardening agents, for example, may be present, as desired. The pH of the developer is preferably high, being at least 9, and most preferably the pH of the developer is from 9.5 to 12.3.

The fixing agents generally used can be used for the fixing agent. In addition to thiosulfate and thiocyanate, organic sulfur compounds which are known to be effective as fixing agents can also be used as fixing agents. Water-soluble aluminum salts, such as aluminum sulfate and alum, for example, can be present in the fixer as film hardening agents. The amount of water-soluble aluminum salt used is generally from 0 to 3.0 g.Al/liter. Furthermore, ethylenediaminetetraacetic acid ferric complex salts may be used as oxidizing agents.

The processing temperature is generally within the range from 18° C. to 50° C., but a temperature below 18° C. and above 50° C. can also be used.

The use of an automatic processor is preferred for the processing in the present invention, and in this case the processes of development, fixing, washing and drying are included and negative gradation photographic characteristics with adequately ultrahigh contrast are obtained even when the total time from the introduction of the photosensitive material to the emergence of the photosensitive material is short as from 90 to 120 seconds.

The present invention is described in greater detail below by means of illustrative examples. Unless otherwise indicated, all parts, percents ratios and the like are by weight.

EXAMPLE 1

(1). Preparation of Polyester Film (Support)

A polyester containing 170 ppm of elemental antimony, 60 ppm of elemental magnesium and 30 ppm of elemental phosphorus was dried under vacuum for 6 hours at 180° C.

This dried polyester was extruded to a thickness of 1.2 mm at 280° C. by injection and, after stretching 2.5 times in the longitudinal and transverse directions with a long extending machine, the polyester was thermally fixed for 1 minute at 230° C. and a polyester film of thickness of 102 μm was obtained.

(2). Underlayer Coating (i) Preparation of Support A

An electrically conductive layer of the composition shown below was coated after coating both sides of the above described polyester film in such a way as to provide 14 mg/m$^2$ of gelatin and 9 mg/m$^2$ of the reaction product of a polyamide of diethylenetriamine and adipic acid with epichlorohydrin, and then the gelatin layer of the composition shown below was coated on both sides of the support.

| | |
|---|---|
| Electrically Conductive Layer | |
| $SnO_2$/Sb (9/1 by weight, average size: 0.25 μm) | 165 mg/m$^2$ |
| Gelatin | 19 mg/m$^2$ |
| Gelatin Layer | |
| Gelatin | 35 mg/m$^2$ |
| Salicylic Acid | 17 mg/m$^2$ |
| Reaction Product of Polyamide Comprising Diethylenetriamine and Adipic Acid with Epichlorohydrin | 6 mg/m$^2$ |

(ii) Preparation of Support B

After subjecting both sides of the polyester film obtained in (1) above to a corona discharge treatment under the conditions shown below, an aqueous dispersion of a methyl methacrylate/butyl acrylate/acrylonitrile (45/45/10 by weight) copolymer was coated to provide a coating of 0.3 g/m$^2$ (solids basis) and dried. After a corona discharge treatment, an aqueous dispersion of a vinylidene chloride/methyl methacrylate/acrylonitrile (90/8/2 wt%) copolymer was coated on top of both sides to provide a coating of 1 g/m$^2$ as (solids basis) and dried. Moreover, after a corona discharge treatment, 0.1 g/m$^2$ of gelatin, 5 mg/m$^2$ of Compound 13 shown below and 5 mg/m$^2$ of methyl cellulose (60SH-6, made by the Shinetsu Kagaku Co.) were coated on top of both sides and dried.

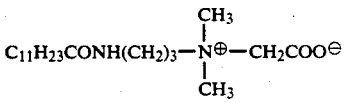

Corona Discharge Conditions

A 6 kVA solid state corona discharge machine made by the Pirra Co. was used and a support of width 30 cm was treated at a rate of 20 m/min. At this time, the material was being treated at 0.375 kVA.min/m$^2$ judging from the reading of the values of electricity and voltage. The frequency during treatment was 9.6 KHz and the gap clearance between the electrode and the dielectric roll was 1.6 mm.

The support obtained in this way was designated Support B, and sensitive materials were prepared using Support A or Support B.

(3). Composition of the Silver Halide Emulsion Layers (upper and lower emulsion layers)

Monodisperse cubic silver iodobromide emulsions (coefficient of variation: 12%, silver iodide content: 0.5 mol%, uniform iodide distribution) were prepared using the controlled double jet method so that the grain size was as indicated for Emulsion Numbers 1 to 5 in Table 1. $K_3IrCl_6$ was mixed with the halogen solution to provide a content of $4\times10^{-7}$ mol/Ag and added to the silver iodobromide emulsions. The emulsions were desalted using flocculation and then the compound indicated below was added in an amount of $5\times10^{-4}$ mol per mol of silver as a sensitizing dye and a potassium iodide solution was added in an amount of $10^{-3}$ mol per mol of silver while maintaining a temperature of 50° C. and the temperature was reduced after aging for 15 minutes.

Sensitizing Dye

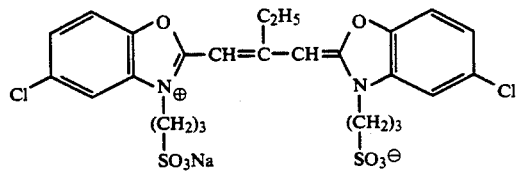

As stabilizer, 4-hydroxy-6-methyl-1,3,3a,7-tetraazaindene and 5-methylbenzotriazole, and Compounds (a) and (b) indicated below were added to the emulsion such that each was coated in an amount of 5 mg/m$^2$.

(a)

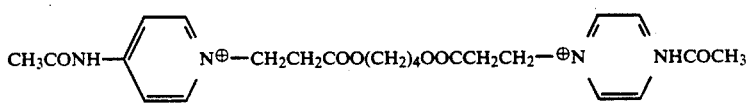

(b)

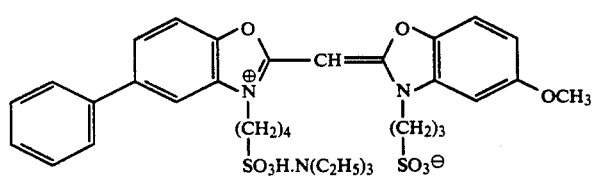

The compound indicated below was added to provide a coated weight of 10 mg/m$^2$ as a hydrazine compound.

Hydrazine Compound

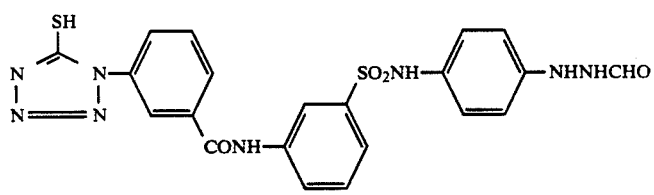

After adding Compound II-9 described above to the emulsion in an amount of $8.0\times10^{-3}$ mol/mol.Ag, polyethylene glycol of average molecular weight 600 was added to provide a coated weight of 75 mg/m$^2$, a poly(ethyl acrylate) dispersion was added in a ratio of 30% to gelatin (as solids), and 85 g/m$^2$ of 1,3-divinylsulfonyl-2-propanol was added as a film hardening agent. The emulsions were coated on the supports described above in such a way that the total amount of silver in the upper and lower emulsion layers was 3.6 g/m$^2$.

The coated silver weights of the upper and lower emulsion layers, the silver halide grain sizes of the upper and lower emulsion layers and the difference in photographic speed between the upper and lower layers ($\Delta$logE) were as shown in Table 1 below.

(4). Composition of the Emulsion Side Protective Layer

A layer which contained 1.2 g/m$^2$ of gelatin, 40 mg/m$^2$ of amorphous $SiO_2$ matting agent of a particle size about 3 $\mu$m, 0.1 g/m$^2$ of Methanol Silica (a trade name of a product from Du Pont), 100 mg/m$^2$ of polyacrylamide, 200 mg/m$^2$ of hydroquinone and 7 mg/m$^2$ of silicone oil, along with 3 mg/m$^2$ of the fluorine containing surfactant of the structural formula shown below and 60 mg/m$^2$ of sodium dodecylbenzenesulfonate as coating aids, was coated simultaneously over the top.

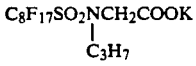

(5). Backing Layer Composition

A layer of the composition shown below was coated as a backing layer on the opposite side of the support to the emulsion layer side.

| | |
|---|---|
| Gelatin | 4 g/m$^2$ |
| Latex: Poly(ethyl acrylate) | 2 g/m$^2$ |
| Surfactant: Sodium p-Dodecylbenzenesulfonate | 40 mg/m$^2$ |
| Surfactant: | 5 mg/m$^2$ |

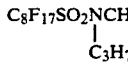

| | |
|---|---|
| Gelatin Hardening Agent: | 110 mg/m$^2$ |

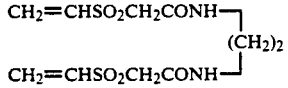

| | |
|---|---|
| Dyes: A mixture of Dyes (a), (b) and (c) | |
| Dye (a) | 50 mg/m$^2$ |
| Dye (b) | 30 mg/m$^2$ |
| Dye (c) | 50 mg/m$^2$ |

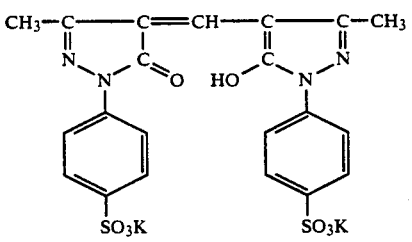

Dye (a)

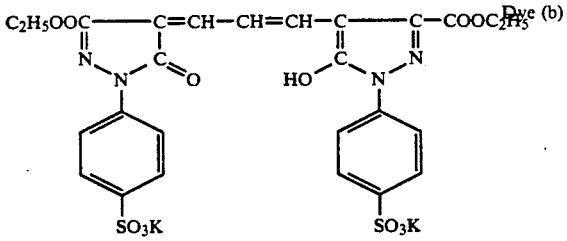

Dye (b)

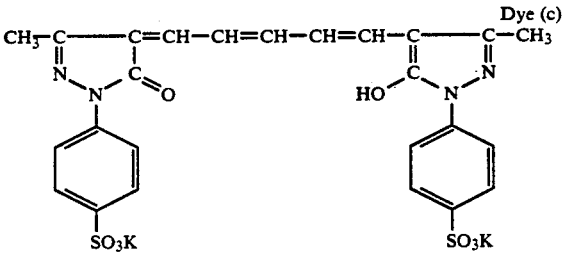

Dye (c)

(6). Backing Layer Side Protective Layer Composition

A layer of the composition shown below was coated over the backing layer as a backing layer protective layer.

| | |
|---|---|
| Gelatin | 0.8 g/m$^2$ |
| Fine Poly(methyl methacrylate) Particles (average particle size: 3.4 μm) | 30 mg/m$^2$ |
| Sodium Dihexyl-α-sulfosuccinate | 15 mg/m$^2$ |
| Sodium Dodecylbenzenesulfonate | 15 mg/m$^2$ |

The sensitive materials prepared in this way were evaluated using the method described below.

Preparation of Original

A step wedge in which the screen percent changed stepwise was prepared using special paper SP-100 wp and a monochromatic scanner SCANART 30 made by the Fuji Photo Film Co., Ltd. The number of screen lines at the time of exposure was 200 lines/inch.

Photography

The original described above and the sample were set in the prescribed positions in a plate making camera C-880F (Fine Zoom) made by Dainippon Screen Co. and photographs were taken by directing an iodine lamp onto the reflecting original.

The sensitive material was rolled with the emulsion surface innermost and exposure of the emulsion layer was made through the support from the back of the sensitive material.

Tests were carried out with the C-880F filter width set at 5 mm, the scan speed set at a low speed and the exposure index between 50 and 80.

Evaluation

Evaluation was carried out by measuring, using Macbeth model TD-904, the screen percent of the dot part (small dot side) of 80% on the original when photographed so that the exposure of the C-880F was adjusted and the 20% dot part of the original was worked at 86%. Since the ease of attaining the small dot side was being evaluated, a larger value indicates a better reproduction of dots.

Furthermore, $D_{max}$ was evaluated by measuring the black solid part of the sample (the white base part of the original) on the same sample with a Macbeth model TD-904.

The photographic speed was obtained by exposure from the back for 5 seconds through an optical wedge for sensitometric purposes using a tungsten light of a color temperature of 3,200° K. and measuring the exposure (logE) of the area of the developed and processed sample of fog+D=1.5.

Furthermore, the composition of the developer used is indicated below.

| Developer Composition | |
|---|---|
| Hydroquinone | 25.0 g |
| 4-Methyl-4-hydroxymethyl-1-phenyl-3-pyrazolidone | 0.5 g |
| Potassium Sulfite | 90.0 g |
| Diethylenetriaminepentaacetic Acid | 2.0 g |
| Potassium Bromide | 5.0 g |
| 5-Methylbenzotriazole | 0.2 g |
| 2-Mercaptobenzimidazole-5-sulfonic Acid | 0.3 g |

-continued

| Developer Composition | |
|---|---|
| Sodium Carbonate | 50.0 g |
| Sodium Hydroxide added to adjust to pH 10.7 | |
| Water to make | 1 liter |

Fixer GR-Fl made by the Fuji Photo Film Co., Ltd. was used for the fixer and processing was carried out under development conditions of 34° C. for 30 seconds using an automatic processor LD-281Q made by the Dainippon Screen Co.

The results obtained are shown in Table 1 below.

TABLE 1

| Sample No. | Support | Emulsion Layer (lower layer) Emulsion No. | Grain Size (μm) | Coated Silver Weight (g/m²) | Speed (logE) | Emulsion Layer (upper layer) Emulsion No. | Grain Size (μm) | Coated Silver Weight (g/m²) | Speed | Difference in Speed (upper layer-lower layer) | $D_{max}$ | Dot Reproduction (minimum dot %) | Remarks |
|---|---|---|---|---|---|---|---|---|---|---|---|---|---|
| 1 | A | 1 | 0.25 | 3.6 | 1.00 | | | | | 0.0 | 5.20 | 5 | Comparison |
| 2 | " | 2 | 0.28 | 3.6 | 1.13 | | | | | 0.0 | 4.95 | 6 | " |
| 3 | " | 3 | 0.32 | 3.6 | 1.31 | | | | | 0.0 | 4.62 | 6 | " |
| 4 | " | 4 | 0.36 | 3.6 | 1.50 | | | | | 0.0 | 4.30 | 5 | " |
| 5 | " | 5 | 0.40 | 3.6 | 1.72 | | | | | 0.0 | 4.05 | 5 | " |
| 6 | " | 1 | 0.25 | 1.8 | 1.00 | 2 | 0.28 | 1.8 | 1.13 | 0.13 | 5.30 | 10 | Invention |
| 7 | " | " | " | " | " | 3 | 0.32 | " | 1.31 | 0.31 | 5.45 | 11 | " |
| 8 | " | " | " | " | " | 4 | 0.36 | " | 1.50 | 0.50 | 4.80 | 6 | Comparison |
| 9 | " | " | " | " | " | 5 | 0.40 | " | 1.72 | 0.72 | 4.35 | 5 | " |
| 10 | " | 2 | 0.28 | " | 1.13 | 1 | 0.25 | " | 1.00 | −0.13 | 4.43 | 5 | " |
| 11 | " | 3 | 0.32 | " | 1.31 | " | " | " | " | −0.31 | 4.10 | 4 | " |
| 12 | " | 4 | 0.36 | " | 1.50 | " | " | " | " | −0.50 | 3.72 | 2 | " |
| 13 | " | 5 | 0.40 | " | 1.72 | " | " | " | " | −0.72 | 3.60 | 0 | " |
| 14 | " | 2 | 0.28 | " | 1.13 | 3 | 0.32 | " | 1.31 | 0.18 | 5.15 | 11 | Invention |
| 15 | A | 2 | 0.28 | 1.8 | 1.13 | 4 | 0.36 | 1.8 | 1.50 | 0.37 | 5.20 | 12 | Invention |
| 16 | " | " | " | " | " | 5 | 0.40 | " | 1.72 | 0.59 | 4.70 | 7 | Comparison |
| 17 | " | 3 | 0.32 | " | 1.31 | 2 | 0.28 | " | 1.13 | −0.18 | 4.20 | 4 | " |
| 18 | " | 4 | 0.36 | " | 1.50 | " | " | " | " | −0.37 | 3.76 | 2 | " |
| 19 | " | 5 | 0.40 | " | 1.72 | " | " | " | " | −0.59 | 3.25 | 0 | " |
| 20 | B | 2 | 0.28 | " | 1.13 | 3 | 0.32 | " | 1.31 | 0.18 | 5.13 | 11 | Invention |
| 21 | " | " | " | " | " | 4 | 0.36 | " | 1.50 | 0.37 | 5.24 | 12 | " |
| 22 | " | " | " | " | " | 5 | 0.40 | " | 1.72 | 0.59 | 4.66 | 7 | Comparison |
| 23 | " | 3 | 0.32 | " | 1.31 | 2 | 0.28 | " | 1.13 | −0.18 | 4.13 | 5 | " |
| 24 | " | 4 | 0.36 | " | 1.50 | " | " | " | " | −0.37 | 3.64 | 2 | " |
| 25 | " | 5 | 0.40 | " | 1.72 | " | " | " | " | −0.59 | 3.18 | 0 | " |
| 26 | " | 2 | 0.28 | 0.4 | 1.13 | 3 | 0.32 | 3.2 | 1.31 | 0.18 | 4.85 | 9 | Invention |
| 27 | " | " | " | 0.9 | " | " | " | 2.7 | " | " | 5.03 | 10 | " |
| 28 | " | " | " | 1.5 | " | " | " | 2.1 | " | " | 5.10 | 12 | " |
| 29 | B | 2 | 0.28 | 2.3 | 1.13 | 3 | 0.32 | 1.3 | 1.31 | 0.18 | 5.15 | 12 | Invention |
| 30 | " | " | " | 3.2 | " | " | " | 0.4 | " | " | 4.90 | 8 | " |

It is clear from the results shown in Table 1 above that the samples of the present invention had a high $D_{max}$ and good dot reproduction.

Furthermore, these results show that the effect tends to increase as the ratio of the amounts of silver coated in the upper and lower emulsion layers approaches 1/1.

EXAMPLE 2

Samples were prepared in the same manner as described in Example 1 above except that the silver halide grains indicated below were used for the silver halide grains in the uppermost emulsion layer in Example 1.

Preparation of the Silver Iodobromide Tabular Emulsion (Emulsion No. 6)

Gelatin (30 g) and 6 g of potassium bromide were added to 1 liter of water and an aqueous solution of silver nitrate (5 g $AgNO_3$) and an aqueous solution of potassium bromide which contained 0.05 g of potassium iodide were added using the double jet method over a period of 1 minute while agitating the contents of the vessel and maintaining a temperature of 60° C. Moreover, an aqueous solution of silver nitrate (5 g $AgNO_3$) and an aqueous solution of potassium bromide which contained iridium hexachloride in an amount corresponding to $1.5\times10^{-7}$ mol per mol of silver and potassium iodide were added using the double jet method. At this time, the rate of addition was such that the flow rate at the end of the addition was about 5 times that at the start of the addition. After the addition had been completed the emulsion was desalted using flocculation in the same manner as in Example 1 and sensitizing dyes and additives such as stabilizers, etc., were added in the same manner as described in Example 1. The emulsion so obtained had a projected area diameter of 0.5 μm, an average thickness of 0.07 μm and a silver iodide content of 1 mol%.

Evaluation was carried out in the same manner as described in Example 1.

The results obtained are shown in Table 2.

TABLE 2

| Sample No. | Support | Emulsion Layer (lower layer) Emulsion No. | Grain Size (μm) | Coated Silver Weight (g/m²) | Speed (logE) | Emulsion Layer (upper layer) Emulsion No. | Grain Size (μm) | Coated Silver Weight (g/m²) | Speed | Difference in Speed (lower layer-upper layer) | $D_{max}$ | Dot Reproduction (minimum dot %) | Remarks |
|---|---|---|---|---|---|---|---|---|---|---|---|---|---|
| 31 | B | 6 | 0.5 | 3.6 | 1.68 | | | | | 0.0 | 4.85 | 5 | Comparison |
| 32 | " | 1 | 0.25 | 1.8 | 1.00 | 6 | 0.5 | 1.8 | 1.68 | 0.68 | 4.80 | 6 | " |

TABLE 2-continued

| Sample No. | Support | Emulsion Layer (lower layer) Emulsion No. | Grain Size (μm) | Coated Silver Weight (g/m²) | Speed (logE) | Emulsion Layer (upper layer) Emulsion No. | Grain Size (μm) | Coated Silver Weight (g/m²) | Speed | Difference in Speed (lower layer-upper layer) | $D_{max}$ | Dot Reproduction (minimum dot %) | Remarks |
|---|---|---|---|---|---|---|---|---|---|---|---|---|---|
| 33 | " | 2 | 0.28 | " | 1.13 | " | " | " | " | 0.55 | 4.74 | 7 | " |
| 34 | " | 3 | 0.32 | " | 1.31 | " | " | " | " | 0.37 | 5.25 | 11 | Invention |
| 35 | " | 4 | 0.36 | " | 1.50 | " | " | " | " | 0.18 | 5.18 | 12 | " |
| 36 | " | 5 | 0.40 | " | 1.72 | " | " | " | " | −0.04 | 4.56 | 7 | Comparison |

As in Example 1, the above results show that the samples of the present invention had a high $D_{max}$ and superior dot reproduction properties.

While the invention has been described in detail and with reference to specific embodiments thereof, it will be apparent to one skilled in the art that various changes and modifications can be made therein without departing from the spirit and scope thereof.

What is claimed is:

1. A method of image information using a silver halide photographic photosensitive material comprising a support having provided on the frontside thereof a plurality of hydrophilic colloid layers, at least two layers of which are silver halide emulsion layers, at least one of said hydrophilic colloid layers contains a hydrazine compound, said photosensitive material further containing at least one compound represented by formulae (II) and (III):

$$Y-((X)_n-A-B]_n \quad \text{(II)}$$

wherein Y represents a group which is adsorbed on silver halide; X represents a divalent linking group comprising an atom or group of atoms including hydrogen, carbon, nitrogen oxygen and sulfur atoms; A represents a divalent linking group; B represents an amino group, an ammonium group, or a nitrogen-containing heterocyclic group, and the amino group may be a substituted amino group; m represents 1, 2 or 3; and n represents 0 or 1;

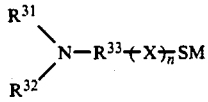

(III)

wherein $R^{31}$ and $R^{32}$ each represents a hydrogen atoms or an aliphatic group, or $R^{31}$ and $R^{32}$ may combine and form a ring; $R^{33}$ represents a divalent aliphatic group; X represents a divalent nitrogen-, oxygen- or sulfur-containing heterocyclic group; n represents 0 or 1; and M represents a hydrogen atom, an alkali metal, an alkaline earth metal, a quaternary ammonium salt, a quaternary phosphonium salt, or an amidino group, the photographic speed of the emulsion layer on the side furthest from the support of said at least two silver halide emulsion layers is higher by 0.1 to 0.4 logE than the photographic speed of the emulsion layer which is closest to the support, comprising the steps of imagewise exposing through the backside of said support and developing said imagewise exposed photosensitive material, whereby a high contrast negative image having a gamma of at least 8 is obtained.

2. The method of image formation of claim 1, wherein the hydrazine compound is a compound represented by the formula (I):

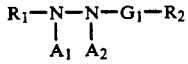

(I)

wherein $R_1$ represents an aliphatic group or an aromatic group; $R_2$ represents a hydrogen atom, an alkyl group, an aryl group, an alkoxy group, an aryloxy group, an amino group, a hydrazino group, a carbamoyl group or an oxycarbonyl group; $G_1$ represents a carbamoyl group, a sulfonyl group, a sulfoxy group, a

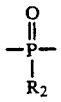

group, a

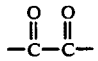

group, a thiocarbonyl group or an iminomethylene group; and $A_1$ and $A_2$ both represent a hydrogen atom, or one represents a hydrogen atom and the other represents a substituted or unsubstituted alkylsulfonyl group, a substituted or unsubstituted arylsulfonyl group, or a substituted or unsubstituted acyl group.

3. The method of image formation of claim 1, wherein the amount of the hydrazine compound is from $1\times10^{-6}$ mol to $5\times10^{-2}$ mol per mol of silver halide.

4. The method of image formation of claim 1, wherein the amount of the compound of the formulae (II) and (III) is from $1\times10^{-3}$ to 0.5 g/m² of the photosensitive material.

5. The method of image formation of claim 1, wherein the weight ratio of the coated silver weight of the silver halide emulsion layer furthest from the support to the coated silver weight of the silver halide emulsion layer closest to the support is 1:5 to 5:1.

6. The method of image formation of claim 1, wherein the developing step is carried out using a developer having a pH of from 9.5 to 11.2.

7. The method of image formation of claim 1, wherein the developing step is carried out using a developer having a pH of from 9.5 to 10.7.

8. The method of image formation of claim 1, wherein the silver halide emulsion layer furthest from the support and the silver halide emulsion closest to the support each contain a compound represented by formula (II).

* * * * *